United States Patent [19]

Ingold

[11] Patent Number: 4,713,922

[45] Date of Patent: Dec. 22, 1987

[54] FRAME MOUNTING STRUCTURE FOR A HOUSING OPENING AND METHOD THEREFORE

[76] Inventor: John P. Ingold, 2590 Beaumont, Green Bay, Wis. 54301

[21] Appl. No.: 905,861

[22] Filed: Sep. 10, 1986

[51] Int. Cl.[4] ..... E04C 2/38

[52] U.S. Cl. ..... 52/656; 49/505; 254/104

[58] Field of Search ..... 52/215, 217, 656, 213; 49/504, 505; 254/104

[56] References Cited

U.S. PATENT DOCUMENTS

| | | | |
|---|---|---|---|
| 2,524,961 | 10/1950 | Cramer, Jr. | 254/104 |
| 2,651,814 | 9/1953 | Lester, Jr. | 49/505 X |
| 2,772,596 | 12/1956 | Trussell | 254/104 X |
| 2,813,311 | 11/1957 | Vaughn | 49/504 X |
| 2,914,817 | 12/1959 | Jackson | 49/505 X |
| 3,171,632 | 3/1965 | Jines | 254/104 |
| 3,345,780 | 10/1967 | McGhee | 49/504 |
| 3,654,734 | 4/1972 | Lehman | 49/505 |
| 3,836,118 | 9/1974 | Meyer | 254/104 |
| 4,395,855 | 8/1983 | Juker | 49/505 X |

*Primary Examiner*—William F. Pate, III
*Assistant Examiner*—Creighton Smith
*Attorney, Agent, or Firm*—Richard J. Myers

[57] ABSTRACT

A building frame structure for a building opening and wedge shim structure for accurately plumbing and locating the frame, such as a door frame or window frame in a doorway opening or window opening, respectively, of a building. The wedge shim structure includes a plurality of shims placed about the frame in plumbed hung frame relationship. Each shim has a first wedge shim part fastened on the frame and a second wedge shim part slidably mountable on the first part for adjustably closing the space between the frame and the studding around the opening for placing a door or window structure in the doorway or window opening. This requires placing a level on the second wedge part of each shim to provide a plumb vertical frame wall on which to hang to door or slidably mount a window. This novel arrangement also provides for a shimming and plumbing method for attaching a door or window in plumb relation with the building opening.

19 Claims, 10 Drawing Figures

FIG. 3
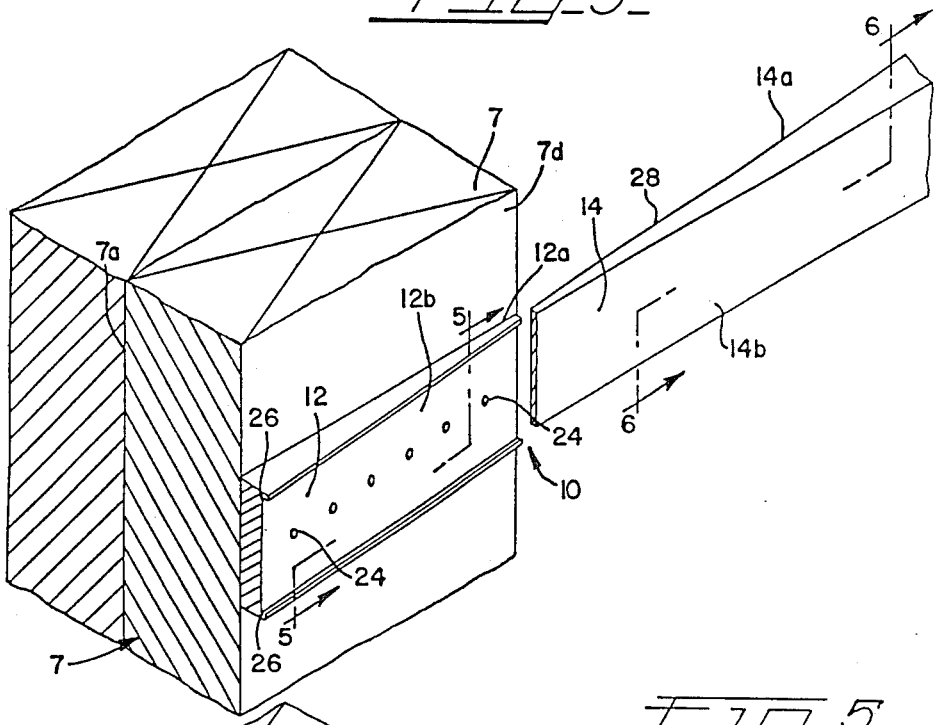
FIG. 5
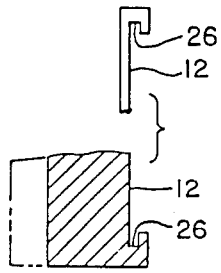
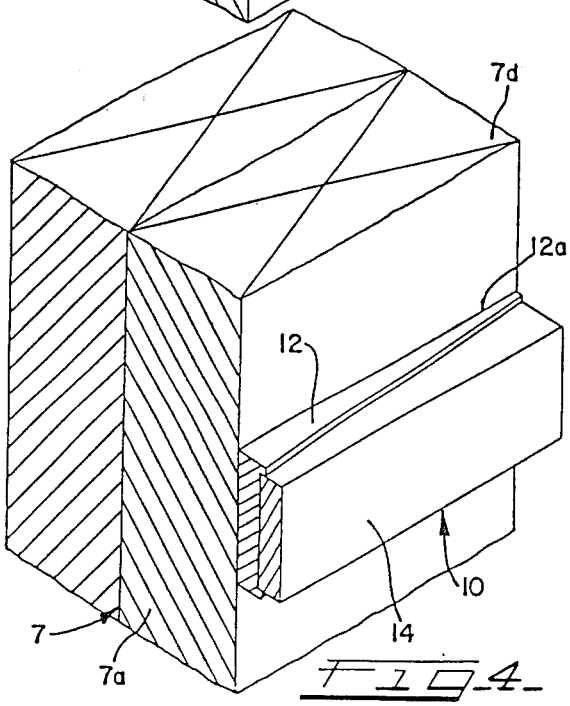
FIG. 4
FIG. 6
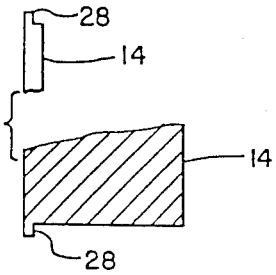

FRAME MOUNTING STRUCTURE FOR A HOUSING OPENING AND METHOD THEREFORE

BACKGROUND OF THE INVENTION

1. FIELD OF THE INVENTION

This invention relates to the mounting of door or window jambs or frames in the rough framed opening of a building, such as doorway or window opening, and in particular where the door or window jamb or frame may be mounted to studding in such an opening.

2. DESCRIPTION OF THE PRIOR ART

It is well known to provide a rough framed stud opening in a building for such installation of door or window jamb. The jamb or frame is held plumb and stationary with the use of a spacer or wedge placed between the studding and the jamb with respect to building, as for instance shown by U.S. Pat. No. 2,865,060 to Pattiani for door framing or U.S. Pat. No. 2,813,311 to Vaughn for window framing. Plumbing of door framing is also shown by the Pattiani patent, as well by the U.S. Pat. No. 2,914,817 to Jackson. It is, however, desired to provide an accurate structure to be placed between the studding and the jamb, which does allow for quick assembly of a door or window jamb without modification to the studding or the jamb and which will insure accurate plumbing of the jamb or frame.

In the Pattiani patent, the design uses dados or grooves in the studding opening and places different size filler blocks to obtain accurate vertical alignment. The interlocking adjustable wedge shim is placed on the vertical face of the studding in horizontal position and then adjusted to obtain accurate alignment.

In the Jackson Patent, the design provides for vertical adjustment only and the wedge must be used with the jamb in conjunction with premachined mortises.

Therefore, in the past, difficult and tedious structures and procedures involving the premachining or other modification of studding and or jamb or frame were utilized in order to maintain plumbing of the jamb. Nor did the shim device provide for horizontal adjustment of the door or window frames.

SUMMARY OF THE INVENTION

The invention provides for the application of a wedge shim structure to the studding for a plumbed vertical and horizontal installation of the jamb or frame. The use of several wedge shims on the vertical stud sides and horizontal, head or sill studding allows installation of the jamb. The wedge shim structure includes a first mounted shim member or unit, which is fastened to the studding of the rough opening. A second wedge shim is slidingly interlocked with the first mounted member. Each wedge member presents a tapered sloped part to complement and mate with the other member to provide an expandable shim surface to allow for the adjustment needed to provide a plumb jamb or frame with respect to the building. Several wedge shim structures are placed on the studding one side of the opening and surface adjustment is obtained by moving the first active part or shim member of the structure back and forth across the second fixed member, increasing or decreasing the thickness of the structure, as needed to provide an accurate plumb surface to install the jamb or frame in opening. This procedure is repeated on head (top of studding) and/or sill, as needed. Once plumb is established, the jamb or frame is installed in opening and plumb is maintained by nailing through the jamb or frame at the location of the structure, thus securing all the components in a fixed position plumbed with respect to the building.

It is therefore an object of this invention to provide for a plumbed anchorage between the rough studding of a building opening (such as a doorway or window opening) through the use of adjustable shim structures.

A further object of this invention is to provide for an expandible connection between the studding and the framework jamb until a tight plumbed connection is obtained therebetween.

It is a further object of this invention to provide a dovetail pair of tapered shims that provide an expanded tight fitting between the studding and the framework while plumbing the framework.

Still another object is to provide a method for attaching to studding of a building opening, a framework for a door window, or the like, by interposing adjustable shim means on the studding and attaching the framework to the shim means.

The invention with other objects and advantages thereof, and the particular construction, combination and arrangement of parts comprising the same, will be understood from the following detail description when considered in connection with the accompanying drawings forming part hereof and illustrating on embodiment of the invention.

BRIEF DESCRIPTION OF DRAWINGS

FIG. 3 is a partial frontal perspective exploded view of my adjustable shim of my invention with parts separated;

FIG. 4 is a partial frontal perspective view of my invention with the fixed and movable shim portions interlocked in an interlocking position;

FIG. 5 is a partial cross section of the fixed shim member parts removed and taken along line 5—5 of FIG. 3;

FIG. 6 is a cross section of the active movable member with parts removed and taken along line 6—6 of FIG. 3; and FIGS. *7a*, *7b*, *7c*, and *7d* illustrate various wedge expansions of my invention that can be obtained by sliding the interlocked fixed and movable members relative to one another.

Figure 2:
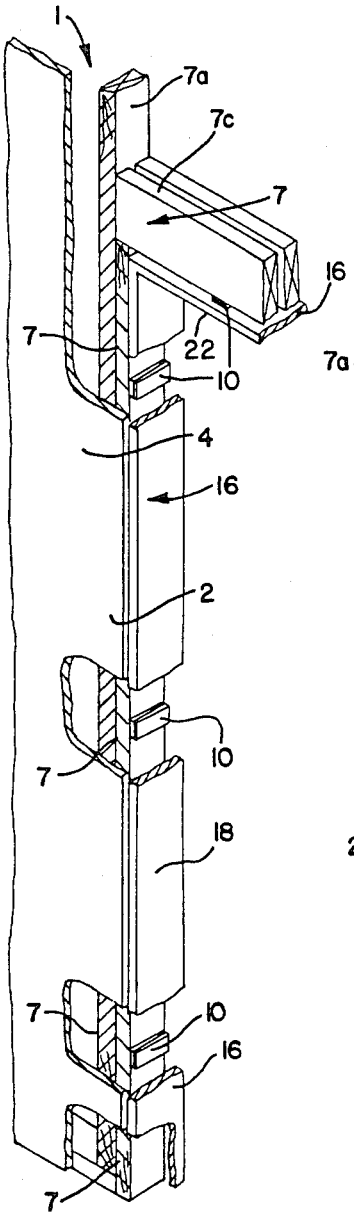
FIG. 2 is a partial enlarged perspective view of my invention.

While a preferred embodiment of the invention is illustrated in the drawings, it will be, of course, understood that minor changes and modification may be made in the particular construction shown and the invention may be embodied in other forms as will appeal to those skilled in the art and falling within the scope of the appended claims without department from the spirit of the invention.

DESCRIPTION OF THE DISCLOSURE

Figure 1:
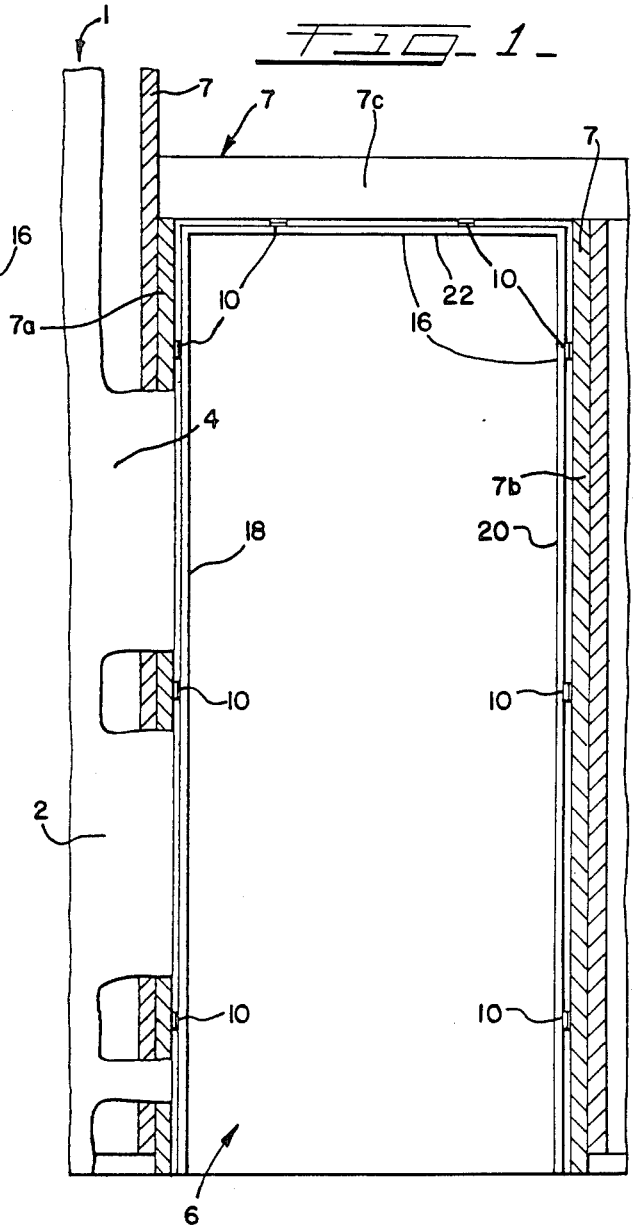
FIG. 1 is a front elevational view of a door opening and framework for a building embodying my invention.
Figure 7A:
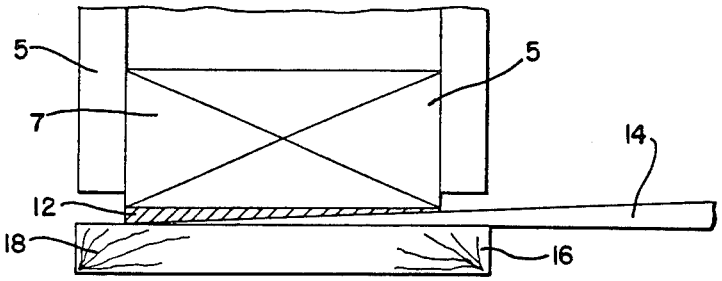
Figure 7B:
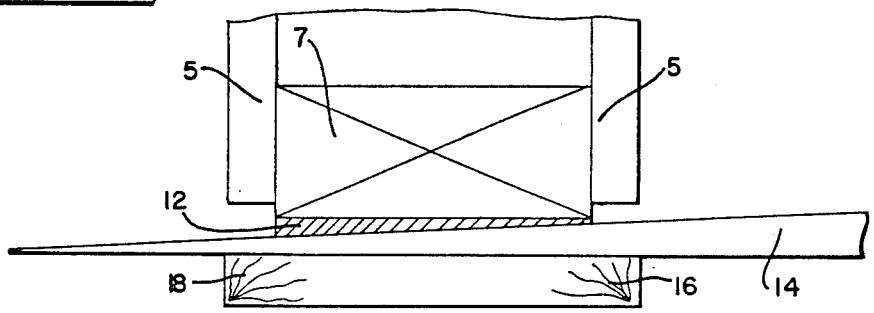
Figure 7C:
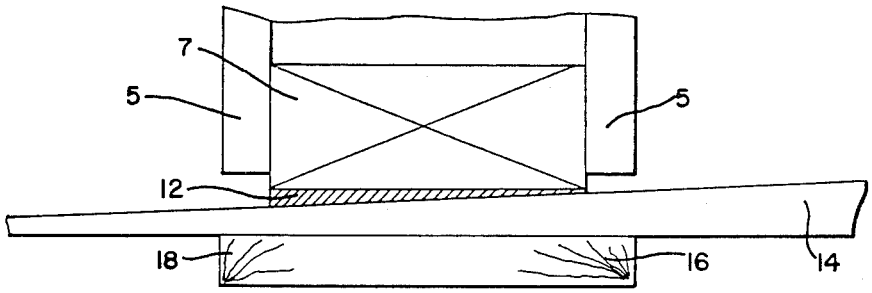
Figure 7D:
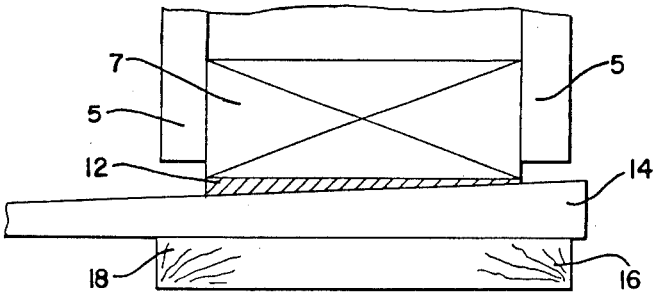

With reference of the drawings now and in particular, with reference to FIGS. 1 and 2 there is seen the application of my invention wherein there is provided for a building 1 having a wall 2 covered with plaster or wallboard 4 with parts broken away to show a doorway opening 6 defined by rough finished doorway studding 7. The doorway studding 7 includes two vertically disposed and laterally spaced elements *7a* and *7b* connected by a horizontal or overhead header studding element *7c*.

The studding 7 is provided with shim or wedge structure 10 in the form of a plurality of shims or wedge elements 12 and 14 mounted on the rough studding elements *7a*, *7b*, and *7c* (see FIGS. 3–6). Door framing (jamb) structure 16 in the form of an inverted U-shaped or bottom open ended rectangularly beam is mounted on the shim structure 10 and includes a vertical leg or door hinge jamb portion 18 and another vertical leg or door lock or catch jamb portion 20 and an overhead leg or header jamb portion 22 connecting with the upper portion of the legs 18 and 20. The novel relationship and application of the shim structure 10 and door framing structure 16 to the studding 7 will be discussed in greater detail below. A door (not shown but exemplied in U.S. Pat. No. 2,651,814 to Lester which is hereby incorporated by reference hereto) may be provided in the usual fashion with hinges (not shown) on door frame section 18 for being hingedly hung from the door hinge jamb portion 18 for closing against a lock and striker jamb portion (not shown) on door frame section 20.

With reference particularly to FIGS. 3 and 4 it is seen that the shim or wedge member 12 is a fixed element in that it is mounted on the doorway studding 7 by fastening structure or nails 24 (see FIG. 3). These wedge elements 12 are to be first attached to the vertical surface of the studding element *7a* to which the door hinge jamb leg 18 of the door framing 16 will be attached. Preferably at least two of these elements 12 are to be attached in vertical spaced relation from one another. Each element 12 is provided with a pair of opposed end groove on edge portions 26 (see FIG. 5) extending the longitudinal extent of the element 12 for receiving complementary end lug or dovetail or edge portions 28 (see FIG. 6) of an associated wedge element 14. The intermeshing of the groove portions 26 and lug portions 28 provide a sliding coupling relationship when the two elements 12, 14 are placed together with the grooves 26 of element 12 receiving the lug portion 28 of element 14. Further element 12 is wedged shaped or tapered to become increasingly thicker in cross section along its length as it proceeds from one end of thereof longitudinally to the other end. Also one longitudinally extending surface 12*a* of the element 12 is flat and straight when lying on a flat surface *7d* of stud *7a* (see FIG. 3) while the other side or opposed longitudinal surface 12*b* of element 12 though flat and straight is tapered and sloped in elevation from one longitudinal end to the other longitudinal end. The groove portion 26 of the element 12 is located on the sloped surface or side of the element. Also the second element 14 that carries the lug portion 28 has a flat straight side or surface 14*a* that is not tapered and an opposed tapered or sloped longitudinal side or surface 14*b* slopingly increases as it proceeds along the longitudinal extent of the second element 14, i.e. the slope of element 14 rises as it proceeds to one longitudinal end and decreases as it proceeds to the opposite longitudinal end when the second element 14 is lying on its non-sloped or non-tapered side 14*a*. (See FIGS. 3–6).

In assembling the second slidable movable element 14 on the first fixed element 12 which is mounted on the studding portion 7, the straight non-sloped or non-tapered side surface 12*b* of the first wedge element 12 is placed and fastened (as by nailing) against the surface of the first upright studding element *7a*. Then the second wedge element 14 has its sloped or tapered side 14*b* placed against the now outwardly facing sloped side 12*b* of the first element 12 by inserting the lug or tongue 28 of the second element 14 into the grooves 26 of the first element 12. At this point it is to be noted that since the sloped surfaces of each of the wedge elements 12 and 14 abut each other in sliding relationship and held together by their tongues and grooves and are so inserted one into the other that the lower or thinner taper end of the first element engages initially the thinner tapered end of the second element 14 whereby the outward facing non-touching surfaces of both elements 12, 14 are parallel to one another and allow non-taper engaging surfaces of the studding 7 and the framing 16 to be parallel to one another whereby the door way frame 16 will be always having its edge parallel to the edge of the studding 7. Movement of the thicker or wider taper portions of the wedge elements 12, 14 toward one another by moving the thin end of movable wedge 14 toward the thicker end of the fixed wedge 12 will cause the thickness of the combined wedges or elements 12, 14 to be thicker or greater causing the thickness of the shim structure 10 to be greater. By doing this to the two sets 10 of vertically spaced wedge elements 12, 14 and applying a level to each set 10 of wedge elements 12, 14, a plumb or plumb line (vertical) condition for the upper and lower set of fixed and movable elements 12, 14 can be obtained and the both sets of wedges 12, 14 can be fastened as by nailing and the vertical side of the hinge jamp 18 of the door framing 16 can be placed against the both secured sets 10, 10 of wedges 12, 14 in a similar plumb condition. The extra portion of the movable wedge 14 that projects beyond to doorway is cut off when assembly of the shim structure and door jamb is completed.

It will be appreciated that various materials may be used for the shim structure such as wood or plaster or metal or the like. Also, the sloped surfaces of the wedges may be serated or rachet designed.

FIGS. *7a*, *7b*, *7c*, and *7d* show various positions where by relative positioning of the wedge shim structure can have its width dimension increased or decreased to obtain the plumb line necessary for the framing structure. By sliding the active member 14, an infinite number of positions can be obtained to plumb the jamb or frame. The portion of the active member 14 that protrudes past the wallboard would be cut off to allow for the trim to be installed.

OPERATION

With respect to the application of the wedge shim device 10 to the studding 7 and jamb or framing 16 is as follows: In FIG. 3, we see the stud 7 with the fixed wedge member 12 attached. This is accomplished with the use of adhesives or a nail 24 driven into the fixed shim member 12, then into the stud 7. If a nail is used it must be countersunk sufficiently, so as not to interfere with the movement of location of the active movable shim member 14, as seen in FIGS. 4, *7a*, *7b*, *7c*and *7d* to obtain the proper plumb alignment for the wedge device 10 (FIG. 5) between the studding 7 and the jamb 16.

The finished installation of a door or window jamb is obtained with the basic procedure. However, the exact number and location of the wedge shim structure 10 is not defined, and it is at the discretion of the installer, with respect to the factors, procedures and discrepancy of that given rough opening. However the use and purpose of the adjustable wedge shim will remain the same in all openings.

In viewing FIGS. 1 & 2 we can see a relative location of the adjustable wedge shim device 10 with respect to the stud opening inclusive of the studding 7 and jamb 4. In the FIG. 1 the use of eight adjustable wedge shim devices 10 is shown with six adjustable wedge shims 12, 14 applied to the stud sides *7a*, *7b*and two adjustable wedge shims 12, 14 applied to jamb head *7c*.

With the use of eight adjustable wedge shims 12, 14 as shown in FIG. 7, the installation of the jamb 16 would be as follows: Six fixed members 12 would be installed to the studs *7a*, *7b* and two fixed shim members 12 would be installed to the head *7c* with the use of adhesives or nails as previously disclosed. With six fixed members 12 installed to the stud *7a*, *7b* in a horizontal position parallel to the floor and two fixed members 12 installed to the head *7c* in the same manner, we would now interlock the active members 14 with the eight fixed members at all positions, maintaining the minimum position of adjustment of the wedge shim device 10 as shown in FIG. *7a*. At this point we will begin the procedure to prepare the rough opening for jamb 16 installation. We will begin on the left side (see FIG. 1), however, it must be noted that the procedure can begin on either side. With three adjustable wedge shims 12, 14 attached to the stud 3 and the wedge shims in the position of minimum thickness, a level is now placed against the wedge shims 12, 14. This level should be of such length that it will be greater than the distance between the highest position and lowest position of the wedge shims 12, 14 with respect to the stud 7. With the level in this position, a reading can be made as to the relative position of the stud 7 and the desired plumb position needed to install the jamb 16. If the level reading shows that the wedge shim 12, 14 at the highest position is in excess of 90° in respect to the wedge shim at the lowest position, understanding that all wedge shims 12, 14 are at the minimum position of adjustment FIG. *7a*, than the highest positioned shim 12, 14 will be adjusted to a greater thickness of the wedge shim as shown in *7b*, *7c*, and *7d* to the needed adjustment for a 90° position of the level, with respect to the highest and lowest wedge shims 12, 14. At this time, the wedge shims 12, 14 between the highest and lowest position would be increased in thickness to the extent that it would be at the same plane as the two corresponding wedge shims 12, 14. If the stud position is reversed, the angle of the level is less than 90° this procedure would thus be reversed with adjustment beginning with the lowest positioned wedge shims 12, 14.

With the three wedge shims 12, 14 now adjusted to the proper position, this position will be maintained due to friction between the fixed member 12 and active member 14 at the surface and interlock of the members 12, 14 that are commonly shared. Now that the left side of the studding 7 has with the use of the three adjustable wedge shims 12, 14 the outer surface of the wedge shims being on the same plane, plumb and square to the building, we now have the needed accurate points to install the left side of the jamb 16. This is done by placing the inverted U shaped jamb 16 into the rough opening with the left side of this jamb 16 placed against the three wedge shims 12, 14 at such position vertical to allow adjustment of the top of the jamb 16 with the wedge shims 12, 14 that were installed to the stud head *7c*. To secure the position of the jamb 16 and to permanently fix the position and thickness of the wedge shims 12, 14 as adjusted, the left side of the jamb 16 at the points of contact with the wedge shims 12, 14 and studding 7 will be nailed or screwed with the nail or screw passing through the jamb 16, through the wedge shims 12, 14 into the stud 7, thus securing the left side in a permanent location. A carpenter's square will now be used as a gauge to assure that the top portion of the inverted U shaped jamb 16 will be perpendicular to the fixed left side of the studding 7. Once the position of the top of the jamb 16 has been established the two wedge shims, which were previously installed are adjusted to the point of contact with the side of the jamb 16, which is exposed to the surface of the wedge shims 12, 14 at the two position of the wedge shims 12, 14 at the stud head *7c*, the top of the jamb 16 will be secured with the use of nails or screws in the same manner as was the left side installed. With the left side 18 and top 22 of the inverted U shape jamb 16 now in a fixed position and plumb to the building, the level is now placed on the outside face of the right side 20 of the jamb 16, with the use of the level, the right side 20 of the jamb is adjusted to a position parallel to the left side 18 and perpendicular to the top 22, the wedge shims 14 are then adjusted to the proper thickness to allow for contact with the inside of the right side 20 of the jamb 16, it is then secured with the use of nails or screws at the three positions of the wedge shims 12, 14. The inverted U shaped jamb 16 is now installed to the studs *7a*, *7b*and *7c* in a plumb and secure position with relation to the building. An excess exension or portion of the wedge material that protrudes beyond the doorway or window is cut off and used in subsequent application particularly the elongated strip of the movable wedge shim 14.

In an opening where the stud 7 has, when measured from the top to bottom or from side to side, a concave or convex radius, the location of the wedge shim device 10 can be adjusted to accomodate the proper plane needed to maintain a plumb jamb 16.

In an opening where the surface of the stud 7 is twisted where adjustment is needed in an increasing thickness that must also adjust for different plane within the stud 7, the active shim member 12 can be inserted from the opposite side (the reverse of FIG. 3) thus allowing for the correction of the twisted stud while maintaining the needed relationship with the other wedge shims 12, 14 on the studded rough opening.

Having described and illustrated this invention, the applications and functions must be mentioned further. This invention allows for infinite adjustment within the size limits of the member wedges. With the use of adhesives or nails to secure the fix members and insertion of the active member door and window rough opening can quickly and accurately be readied for final jamb or frame installation. It is a novel method of using adjustable wedge shim, which interlocks both members into one tool. This invention, most importantly, is a tool which can be used with most all conventional construction methods, with no modifications to the products used.

While only certain preferred embodiments of this invention have been shown and described by way of illustration, many modifications will occur to those skilled in the art and it is, therefore, desired that it be understood that it is intended in the appended claims to cover all such modifications as fall within the true spirit and scope of this invention.

What is claimed is:

1. Wedge shim means for attaching building opening jamb framework to a building studding surface for plumbing the framework having sides for hanging a closure member on the framework sides in plumb relationship therewith, said shim means comprising:

a pair of tapered shims each having a sloped surface lying against other with the slope surface of one shim going in the opposite direction of the other, one of said pair of shims having an outer generally flat surface generally parallel to the outer flat surface of the other shim and each shim flat surface being angulated with respect to its respective slope surface, said one shim having its flat surface being adapted to be affixed to the studding surface, each shim having top and bottom edge portions and complemental intercoupling and interlocking means on both the top and bottom edge portions for interlocking the one shim to the other shim whereby the other shim is movably supported on the one shim with the sloped surface of each shim movably engaging and facing the other, said other shim being movable mounted on said one shim for varying the width of the shim means and having its flat surface facing for engagement with the framework, said shim means being adjustable to provide for adjustment of the position of one shim with respect to the other along their slope surfaces to determine the thickness of the wedge means to accommodate the spacing between the stud surface of the studding and the jamb surface of the framework to provide for plumbing of the framework on the building studding; and the shims being adapted to be fastened together in immobilized manner to one another after the other movable shim has been placed lengthwise of each other within said one shim to provide the desired shim thickness and for fastening the shims to the studding and the framework to the shims.

2. The invention according to claim 1, and a building aperture means having three sides including first and second vertical building side parts and an interconnecting building overhead part having ends connecting with the sides, and said aperture means having a lower portion connecting with the lower part of the side parts.

3. The invention according to claim 2, and a studding arrangement having similar complementary stud side parts and stud overhead parts to the building side and overhead parts affixed to the corresponding side parts and building overhead part of the building aperture means to define a studding opening to form generally a rectangular configuration with the lower portion of the aperture means, a framework comprising a first vertical jamb side part and a second vertical jamb side part and an interconnecting jamb overhead part connecting with the jamb side parts and being spaced in the studding opening adjacent and engaging saids shim means.

4. The invention according to claim 1, and said one shim means having first interengaging means on its sloped surface and said other shim having second interengaging means on its sloped surface coupling ratcheting with the sloped surface of the first interengaging means for relative incremental movement of each shim with respect to the other.

5. The invention according to claim 4, and said first and second interlocking means having toothed portions for ratcheting with one another.

6. The invention according to claim 1, and and said shim means having a plurality of fix shims each being of a different thickness.

7. The invention according to claim 1, and and means for attaching said one shim to the studding and means for fastening the shims together.

8. The invention according to claim 1, and said movable shim being of greater extent than said fixed shim ann cutable to a length approximate the length of the fixed shim.

9. The invention according to claim 1, and said fixed shim being elongated generally in a horizontal plane and said movable shim being generally in a horizontal plane of the fixed shim and extending generally the length of the fixed shim.

10. The invention according to claim 1, and said edge portions being away from the plane of engagement of the flat surface of the fixed member attachable to the studding in order to expand the thickness of the shim means when moving the movable member relative to the fixed member.

11. The invention according to claim 1, and the interlocking means being located outwardly of the engaging surface of the fixed and movable member and extending longitudinally thereof.

12. A building construction comprising:

a building aperture means having three sides including first and second vertical buliding side parts and an interconnecting building overhead part having ends connecting with the sides, and said aperture means having a lower portion connecting with the lower part of the side parts, a studding arrangement having similar complementary stud side parts and stud overhead parts to the building parts affixed to the corresponding side parts and building overhead part of the aperture means to define a studding opening to form generally a rectangular configuration with the lower portion of the aperture means, wedge shim means mounted in spaced relationship on each stud side part and the stud overhead part, each wedge shim means including a pair of tapered shims each having a sloped surface lying against other with the slope surface of one shim going in the opposite direction of the other, a framework comprising a first vertical jamb side part and a second vertical jamb side part and an interconnecting jamb overhead part connecting with the jamb side parts and being spaced in the studding opening adjacent and engaging said shim means one of said pair of shims having an outer generally flat surface generally parallel to the outer flat surface of the other shim and each shim flat surface being angulated with respect to its respective slope surface, means for fixedly attaching the one shim to the studding with said one shim having its flat surface affixed to the studding surface, each shim having top and bottom edge portions and complemental inter coupling and interlocking means on both the top and bottom edge portions for interlocking the one shim to the other shim whereby the other shim is movably supported on the one shim with the sloped surface of each shim movably engaging and facing the other, said other shim being movable mounted on said one shim for varying the width of the shim means and having its flat surface facing for engagement with the framework, said shim means being adjustable to provide for adjustment of the position of one shim with respect to the other along their slope surfaces to determine the thickness of the wedge means to accomodate the spacing between the stud surface of the studding and the jamb surface of the framework to provide for plumbing of the framework on the building studding; and means for fastening the shims together in immobilized manner to one another after the other movable shim has been placed lengthwise of each other within said one shim to provide the desired shim thickness and for fastening the shims to the studding and the framework to the shims.

13. The invention according to claim 12, and said one shim means having first interengaging on its sloped surface and said other shim having second interengaging means on its sloped surface ratcheting with the sloped surface of the first interlocking means for relative incremental movement of each shim with respect to the other.

14. The method of assembling wedge shim means in between the studding and building jam framework for building apertures having aperture closures, such as door means and window means, the shim means comprising and pair of shims;

one of said pair of shims having an outer generally flat surface generally parallel to the outer flat surface of the other shim and each shim flat surface being angulated with respect to its respective slope surface, and each shim having top and bottom edge portions and complemental inter coupling and interlocking means on both the top and bottom edge portions and said method comprising the steps of:

(1) affixing studding arrangement in the building aperture;

(2) fixedly placing the one sloped fixed shim of the shim means on the studding arrangement with its sloped surface facing outward;

(3) sliding the edge portions of the other sloped movable shim into the edge portions of the fixed shim in intercoupling and interlocking relation with the sloped surface engaging the sloped surface of the movable shim of the fixed wedge;

(4) placing the jamb framework aganist the movable shim;

(5) moving the movable shim relation to the fixed shim to adjust expand and the combined thickness of both wedge shims as desired until the expanded shim means contact both the studding and the jamb framework; and (6) affixing the studding arrangement, the both shims and the framework all together.

15. The invention according to claim 14 and including the steps of:

(1) having the studding having at least three sides generally in the form inverted U-shaped structure in the building aperture, and;

(2) also having the jam framework being in the shape of an inverted U-shaped structure in complemental attachment with the inverted U-shaped studding via the shim means;

(3) the jambing having a first side leg for the first side leg of the studding, and a second side leg for the second leg of the studding, and an over-head leg for the over-head leg of the studding;

(6) the fixed shim of appropriate length and thickness being first attached on the first stud side part of the studding, and;

(7) then the movable shim being so located on the fixed shim to define the required shim thickness for plumbing, and;

(8) then attaching the first leg of the jam structure to the shim means and the first leg of the studding with the fastening means, and;

(9) then attaching the first leg of the studding and of jamb framework and there inbetween shim means all together, and;

(10) then attaching further shim means to the overhead leg of the studding;

(11) adjusting the shim means on the overhead studding, and;

(12) attaching the jamb overhead leg to the overhead shim means and the studding overhead leg and;

(13) lastly attaching the shim means to the studding second leg, and;

(14) attaching the second leg jambing to the shim means and the studding second leg.

16. The invention according to claim 15, and and trimming off any excess movable shim extending beyond the fixed shim.

17. The invention according to claim 14, and the sloped sufaces of the interconnecting fixed and movable shims being ratcheted for incremental movment of movable shim with respect to the fixed shim.

18. The invention according to claim 14, and said shim means including a plurality of interconnected fixed and movable shims for first the first leg of the studding, then the overhead leg of the studding and lastly for the second leg of the studding.

19. The invention according to claim 18, and said first leg of the studding being a door hinge side and the second leg of the studding being the door striker side.

* * * * *